US010172434B2

(12) United States Patent
Lee

(10) Patent No.: US 10,172,434 B2
(45) Date of Patent: Jan. 8, 2019

(54) COMPACT CONTAINER HAVING ROTATING CONTENTS CONTAINER

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 30 days.

(21) Appl. No.: 15/612,980

(22) Filed: Jun. 2, 2017

(65) Prior Publication Data

US 2017/0347775 A1 Dec. 7, 2017

(30) Foreign Application Priority Data

Jun. 7, 2016 (KR) ..... 10-2016-0070039

(51) Int. Cl.

| | |
|---|---|
| ***B65D 85/00*** | (2006.01) |
| ***A45D 40/24*** | (2006.01) |
| ***A45D 33/00*** | (2006.01) |
| ***A45D 40/22*** | (2006.01) |
| ***A45D 42/02*** | (2006.01) |

(52) U.S. Cl.

CPC ..... *A45D 40/24* (2013.01); *A45D 33/003* (2013.01); *A45D 33/008* (2013.01); *A45D 40/22* (2013.01); *A45D 40/222* (2013.01); *A45D 42/02* (2013.01); *A45D 2040/223* (2013.01); *A45D 2040/224* (2013.01); *A45D 2040/225* (2013.01)

(58) Field of Classification Search

CPC ..... A45D 40/24; A45D 40/222; A45D 42/02; A45D 33/003; A45D 2040/223; A45D 40/22; A45D 33/008; A45D 2040/224; A45D 2040/225

USPC ..... 206/223, 581, 235, 385, 823; 132/293, 132/294, 295, 296, 298, 299, 303, 305

See application file for complete search history.

(56) References Cited

U.S. PATENT DOCUMENTS 1,489,788 A * 4/1924 Reid ..... A45D 33/22 132/296

1,511,525 A * 10/1924 Saart ..... A45D 33/006 132/296

(Continued)

FOREIGN PATENT DOCUMENTS

KR 10-1257628 B1 4/2013

*Primary Examiner* — Jacob K Ackun
*Assistant Examiner* — Jenine Pagan
(74) *Attorney, Agent, or Firm* — Heedong Chae; Lucem, PC

(57) ABSTRACT

The present invention relates to a compact container having a rotating contents container, in which a button frame integrally formed thereon with a button is coupled to the inside of a container body, a support is hinged to the inside of the container body, a rotation frame is rotatably coupled to the inside of the support, a contents container accommodating an impregnation member is fixedly coupled to the inside of the rotation frame, wherein first and second latching protrusions are formed on the button frame and the rotation frame, respectively, to be latched to each other, thus the second latching protrusion of the rotation frame is latched to the first latching protrusion of the button frame when lifting the support from the container body to rotate the contents container, such that the rotation frame is automatically rotated at a predetermined angle, thereby improving the convenience of use.

4 Claims, 8 Drawing Sheets

(56) References Cited

U.S. PATENT DOCUMENTS

| | | | | |
|---|---|---|---|---|
| 1,583,120 | A * | 5/1926 | Brenner | A45D 33/006 132/296 |
| 1,612,409 | A * | 12/1926 | Anderson | A45D 33/025 132/295 |
| 5,437,294 | A * | 8/1995 | Ebbets, III | A45D 40/22 132/296 |
| 2007/0175893 | A1* | 8/2007 | Fraillon | A45D 33/006 220/23.89 |
| 2008/0000493 | A1* | 1/2008 | Anderson | A45D 33/006 132/295 |
| 2009/0320874 | A1* | 12/2009 | Boye | A45D 33/006 132/295 |
| 2010/0051047 | A1* | 3/2010 | Wang | A45D 33/008 132/295 |
| 2014/0283870 | A1* | 9/2014 | Byeon | A45D 33/006 132/315 |
| 2016/0270510 | A1* | 9/2016 | Kang | A45D 33/24 |
| 2016/0353857 | A1* | 12/2016 | Kim | A45D 33/008 |

* cited by examiner

COMPACT CONTAINER HAVING ROTATING CONTENTS CONTAINER

CROSS-REFERENCE TO RELATED APPLICATION

This application claims the benefit of Korean application No. 10-2016-70039 filed on Jun. 7, 2016 with the Korean Intellectual Property Office, the disclosure of which is incorporated herein by reference.

BACKGROUND OF THE INVENTION

Field of the Invention

The present invention relates to a compact container having rotating contents container, and more specifically, to a compact container having a rotating contents container in which a button frame integrally formed thereon with a button is coupled to the inside of a container body, a support is hinged to the inside of the container body, a rotation frame is rotatably coupled to the inside of the support, and a contents container accommodating an impregnation member is fixedly coupled to the inside of the rotation frame, wherein first and second latching protrusions are formed on the button frame and the rotation frame, respectively, to be latched to each other, and the second latching protrusion of the rotation frame is latched to the first latching protrusion of the button frame when lifting up the support from the container body to rotate the contents container, such that the rotation frame is automatically rotated at a predetermined angle, thereby improving the convenience of use.

Description of the Related Art

A cosmetic product is a material used for beautifying the appearance of a human body and covering defects of the appearance to enable the human body to appear attractive or for maintaining a health of skins, hairs, and so on. The cosmetic product is mainly classified into basic cosmetics, color cosmetics and functional cosmetics.

Unlike the basic cosmetics for supplying nutrients to the skin, the color cosmetics include pigments for adjusting tones of the skin to improve the aesthetic.

The color cosmetics are divided into a base makeup used for uniformizing the skin color and covering the defects, and a point makeup for partially enhancing the three-dimensional feeling such as lips, eyes, and nails. In general, the base makeup is classified into a makeup base, a foundation, a powder, and so on, and the point makeup is classified into a lipstick, an eyeliner, a mascara, and so on.

The foundation is divided into a solid foundation, a liquid foundation, and a gel foundation according to the form of the cosmetic material. The solid foundation has a high covering function, however, coagulates upon correction makeup. The liquid foundation provides a good adhering feeling, however, has a weak durability. Accordingly, many consumers recently prefer the gel foundation having a considerable and good adhering feeling when applying the gel foundation onto the skin.

In general, the gel foundation is filled into a glass container or a tube container, and used in the manner that the gel foundation is drawn or squeezed on a hand of the user and applied onto the skin using a puff or a hand.

However, the related art causes the inconvenience in that the user is required to wash the cosmetic material put on the hands whenever using the cosmetic material, and the cosmetic material is wasted since the cosmetic material put on the hands is washed as described above.

To solve the problems as the above, as shown in FIG. 1, Korean Patent Registration No. 10-1257628 has been disclosed. The related art pertains to a compact case, in which the foamed urethane foam as accommodated in the compact case, and a gel foundation is impregnated in the foamed urethane foam.

The gel foundation impregnated in the foamed urethane foam is drawn and applied onto the skin when the compact container of the related art is used. When the gel foundation impregnated in the foamed urethane foam is used, although the gel foundation impregnated in a lower portion of the foamed urethane foam still remains, a surface of the foamed urethane foam becomes dry and hardened in the end as the gel foundation in an upper portion of the foamed urethane foam is reduced, thus the gel foundation content cannot be drawn and applied.

Accordingly, the user has to pull out the foamed urethane foam having the hardened surface from the compact case, and then turn over and put back the foamed urethane foam into the compact case to use the gel foundation remaining in the lower portion of the foamed urethane foam.

To solve the above problems, as shown, in FIG. 2, the applicant of the present invention has filed Korean Patent Registration No. 20-0476245 for a cosmetic compact case.

According to the related art, a case body 1 and a lid 2 are coupled by a hinge h, a cosmetic contents acceptor 3 is coupled to the hinge h, and the cosmetic contents acceptor 3 includes a frame 4 and a rotating unit 5 coupled to be rotated inside the frame 4, wherein first and second lids 6 and 7 are hinged to upper and lower portions of the rotating unit 5, and a foamed urethane foam impregnated therein with a gel foundation is accommodated in the rotating unit 5.

According to the related art, after the rotating unit 5 is rotated and mounted on the cosmetic content acceptor 3 to enable the gel foundation remaining in a lower portion of the foamed urethane foam to be located toward the foamed urethane foam, the remaining gel foundation in the foamed urethane foam is used.

However, the related art has the inconvenience in that, after the frame 4 is lifted from the case body 1 to rotate the rotating unit 5, the rotating unit 5 is rotated by a predetermined angle from the frame 4 by pressing one side of the upper portion of the rotating unit 5 with a finger, and then the rotating unit 5 is gripped and turned upside down.

In addition, according to the related art, drips protrude from each one side of the first and second lids 6 and 7 coupled to the upper and lower portions of the rotating unit 5, such that an empty space is formed between the case body 1 and the rotating unit 5, as a result, it is inefficient in utilization of the inner space of the case body 1.

SUMMARY OF THE INVENTION

To solve the problems described above, the present invention provides a compact container having a rotating contents container, in which a button frame integrally formed thereon with a button is coupled to the inside of a container body, a support is hinged to the inside of the container body, a rotation frame is rotatably coupled to the inside of the support, and a contents container accommodating an, impregnation member is fixedly coupled to the inside of the rotation frame, wherein first and second latching protrusions are formed on the button frame and the rotation frame, respectively, to be latched to each other, thus the second latching protrusion of the rotation frame is latched to the first latching protrusion of the button frame when lifting the support from the container body to rotate the contents container, such that the rotation frame is automatically rotated by a predetermined angle, thereby improving convenience of use.

In addition, the present invention provides a compact container having a rotating contents container, in which first and second contents lids are coupled to upper and lower portions of the rotation frame, respectively, and grips are formed on each one side of the first and second contents lids, wherein an insertion hole and a through hole are formed in the container body and the button frame, such that the grips of the first and second contents lids are inserted into the insertion hole while passing through the through hole, so as to prevent an empty space from being formed between the container body and the first and second contents lids, such that, a space inside the container body is efficiently used.

In addition, the present invention provides a compact container having a rotating contents container, in which an inner space of the contents container is divided into a first space and a second space by forming a partition in the contents container, such that the first and second spaces respectively accommodate the impregnation members impregnated therein with different kinds of cosmetic materials for use.

The present invention provides a compact container having a rotating contents container, which including: a container body (10); a container lid (20) for opening and closing the container body (10); a button frame (30) coupled to the inside of the container body (10), and formed thereon with a button (32); a support (40) hinged to the container body (10), and formed therein with a rotation hole (44); a rotation frame (50) formed thereon with a rotation shaft (54), and rotatably coupled to the inside of the support (40); a contents container 60 fixedly coupled to the inside of the rotation frame (50); and an impregnation member (70) accommodated it the contents container (60), and impregnated therein with a cosmetic material, wherein a first latching protrusion (36) is formed on the button frame (30), and a second latching protrusion (56) is formed on the rotation frame (50), thus the second latching protrusion (56) is latched to the first latching protrusion (36) when the support (40) is lifted up, such that the rotation frame (50) is automatically rotated by a predetermined angle.

In addition, the container body (10) is formed at the front thereof with a button insertion hole (12) into which the button (32) of the button frame (30) is inserted, and is formed or a bottom thereof with a grip insertion groove (14).

In addition, a grip insertion hole (34) is formed on a bottom of the button frame (30).

In addition, a first contents lid (51) and a second contents lid (52) are coupled to upper and lower portions of the rotation frame (50), respectively.

In addition, a first grip (512) and a second grip (512) are formed on each one side of the first and second contents lids (51 and 52), respectively, in which one of the first and second grips (512 and 522) is inserted into the grip insertion groove (14) of the container body (10) while passing through the grip insertion hole (34) of the button frame (30).

In addition, a side surface of the rotation frame (50) is formed in an arc shape such as "(", so that the rotation frame (40) can be easily rotated in the support (30).

In addition, a partition (63) is formed inside the contents container (60), thereby dividing an inner space of the contents container (60) into a first space (61) and a second space (62).

According to the compact container having the rotating contents container of the present invention, a button frame integrally formed thereon with a button is coupled to the inside of a container body, a support is hinged to the inside of the container body, a rotation frame is rotatably coupled to the inside of the support, and a contents container accommodating an impregnation member is fixedly coupled to the inside of the rotation frame, wherein first and second latching protrusions are formed on the button frame and the rotation frame, respectively, to be latched to each other, thus the second latching protrusion of the rotation frame is latched to the first latching protrusion of the button frame when lifting up the support from the container body to rotate the contents container, such that the rotation frame is automatically rotated by a predetermined angle, therefore, the convenience of use can be improved.

In addition, according to the compact container having the rotating contents container of the present invention, first and second contents lids are coupled to upper and lower portions of the rotation frame, respectively, and grips are formed on each one side of the first and second contents lids, in which an insertion hole and a through hole are formed in the container body and the button frame, thus the grips of the first and second contents lids are inserted into the insertion hole through the through hole, so as to prevent an empty space from being formed between the container body and the first and second contents lids, so that the space inside the container body can be efficiently used.

In addition, according to the compact container having the rotating contents container of the present invention, an inner space of the contents container is partitioned into a first space and a second space by forming a partition in the contents container, such that the first and second spaces respectively can accommodate the impregnation members impregnated therein with different kinds of cosmetic materials for use.

DETAILED DESCRIPTION OF THE INVENTION

Hereinafter, a compact container having a rotating contents container according to the present invention will be described in detail with reference to the accompanying drawings.

Figure 1:
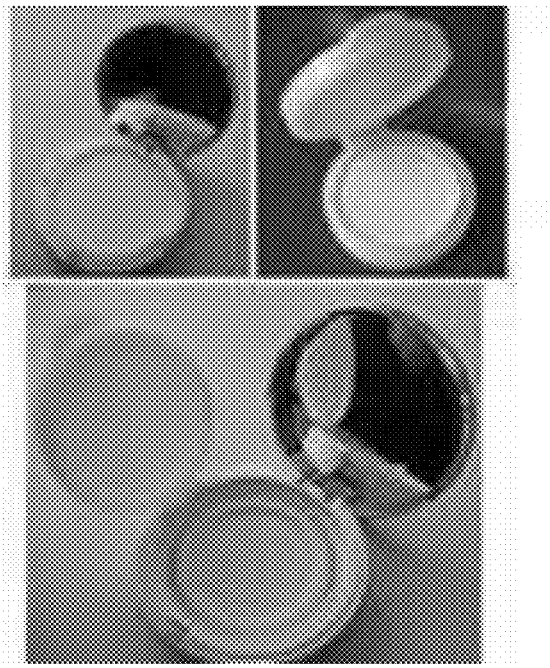
FIG. 1 is a view showing conventional cosmetic products including foamed urethane foam impregnated therein with a cosmetic material composition.
Figure 2:
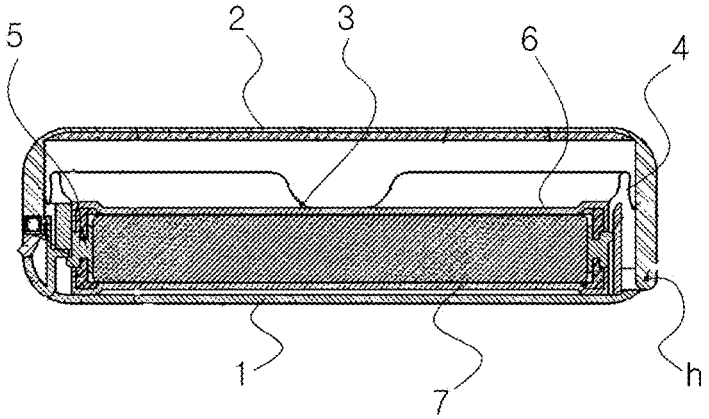
FIG. 2 is a view showing a cosmetic compact case.
Figure 3:
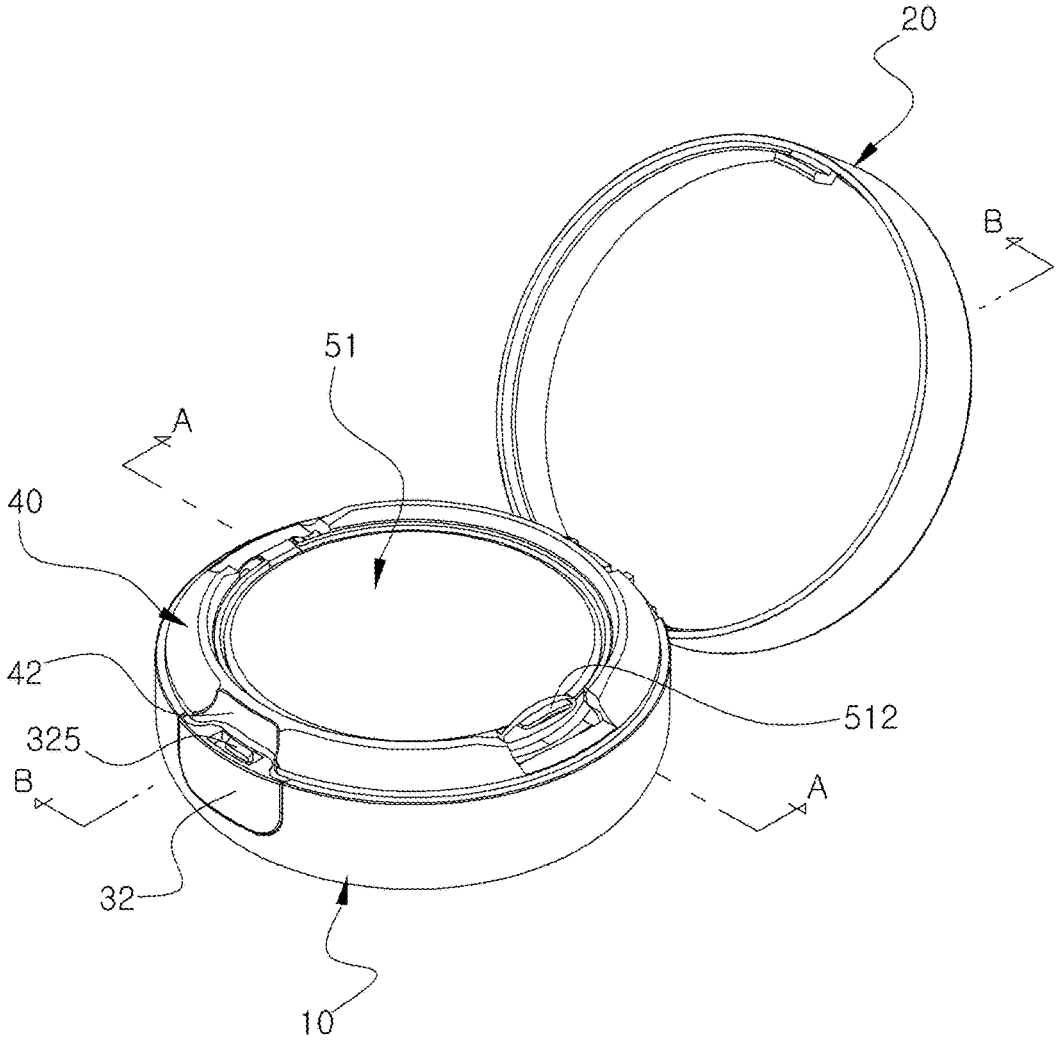
FIG. 3 is a perspective view of a compact container having a rotating contents container according to the present invention.
Figure 4:
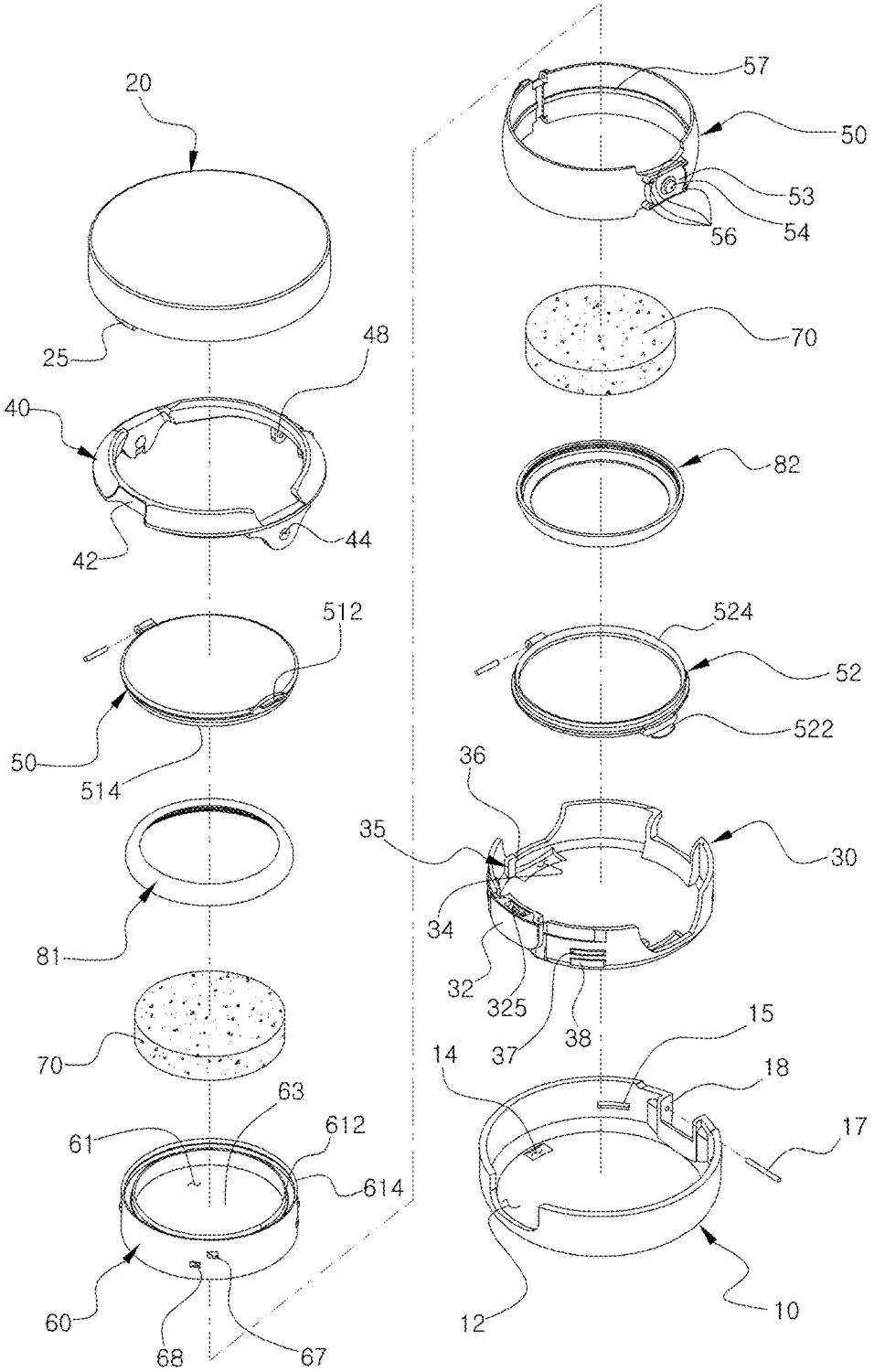
FIG. 4 is an exploded perspective view of a compact container having a rotating contents container according to the present invention.
Figure 5:
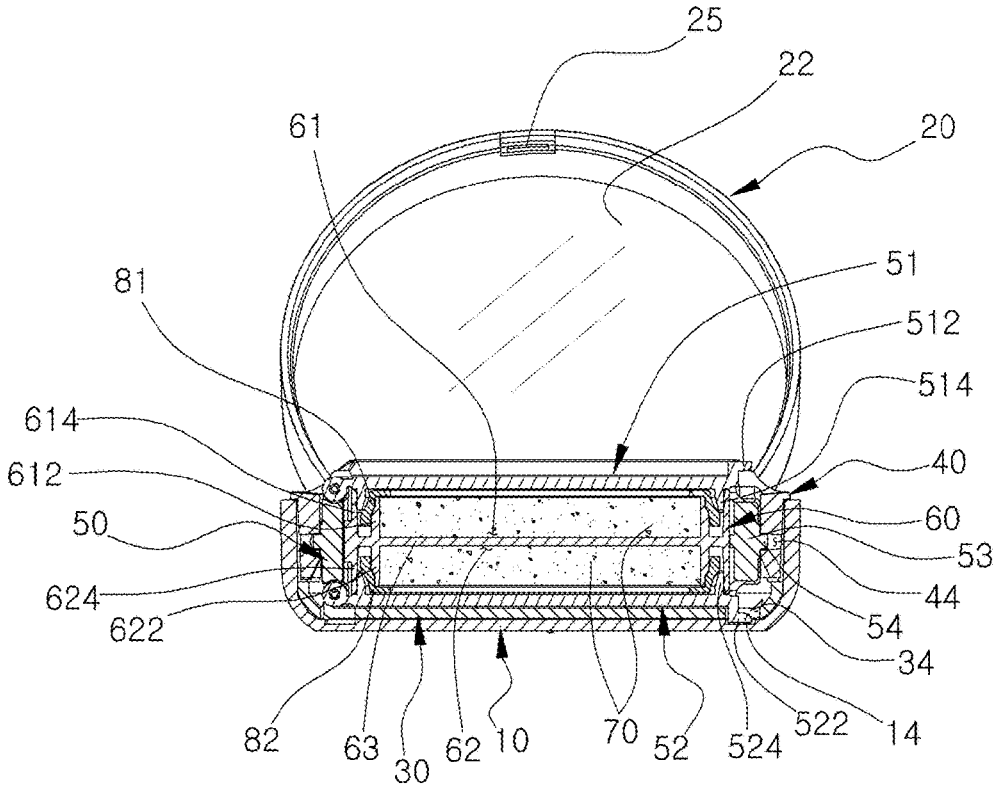
FIG. 5 is a cross sectional view taken along line A-A of a compact container having a rotating contents container according to the present invention.
Figure 6:
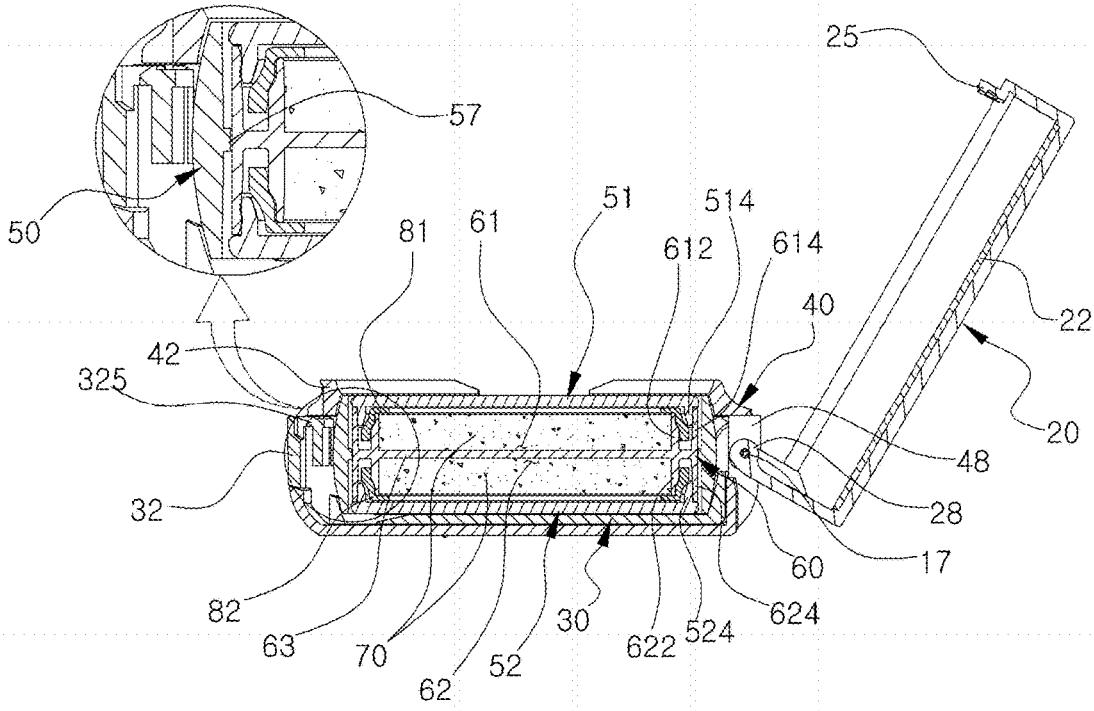
FIG. 6 is a cross sectional view taken along line B-B of a compact container having a rotating contents container according to the present invention.

FIG. 3 is a perspective view of a compact container having a rotating contents container according to the present invention. FIG. 4 is an exploded perspective view of a compact container having a rotating contents container according to the present invention. FIG. 5 is a cross sectional view taken along line A-A of a compact container having a rotating contents container according to the present invention. FIG. 6 is a cross sectional view taken along line B-B of a compact container having a rotating contents container according to the present invention.

The compact container having the rotating contents container according to the present invention includes: a container body 10; a container lid 20 for opening and closing the container body 10; a button frame 30 coupled to the inside of the container body 10, and formed thereon with a button 32; a support 40 hinged to the container body 10, and formed therein with a rotation hole 44; a rotation frame 50 formed thereon with a rotation shaft 54, and rotatably coupled to the inside of the support 40; a contents container 60 fixedly coupled to the inside of the rotation frame 50; and an impregnation member 70 accommodated in the contents container 60, and impregnated therein with a cosmetic material, wherein a first latching protrusion 36 is formed on the button frame 30, and a second latching protrusion 56 is formed on the rotation frame 50, thus the second latching protrusion 56 is latched to the first latching protrusion 36 when the support 40 is lifted up, such that the rotation frame 50 is automatically rotated by a predetermined angle.

The container body 10 has an opened shape at an upper portion thereof, and is mounted therein with a button frame 30 and a support 40.

The container body 10 is formed at the front thereof with a button insertion hole 12 into which the button 32 of the button frame 30 is inserted, and the container body 10 is formed on a bottom thereof with a grip insertion groove 14.

A container hinge part 18 is formed on an opposite side of the button insertion hole 12 of the container body 10, and a coupling protrusion 15 coupled thereto with the button frame 30 is formed on an inner periphery of the container body 10.

The container lid 20 is hinged to one side of the container body 10 to open and close the container body 10, wherein the container lid 20 is formed at one side thereof with a protrusion-shape hook 25, and may be provided therein with a mirror 22 to enable a user to easily make up.

A lid hinge part 28 is formed on an opposite side of the hook 25 of the container lid 20, and hinged to the container hinge part 18 of the container body 10 by a hinge pin 17.

The button frame 30 is coupled to the inside of the container body 10, and formed on a front thereof with a button 32.

The button 32 may be integrally formed on the button frame 30, or separately formed to be coupled to the button frame 30.

A lid latching protrusion 325, which is easily retracted upon a pressing action of the user, protrudes on an upper side of the button 32 and is fastened to the hook 25 of the container lid 20.

A grip insertion hole 34 is formed on the bottom of the button frame 30, and a latching part 35 extends upwardly adjacent to the grip insertion hole 34.

A first latching protrusion 36 formed on an upper side of the latching part 35 protrudes toward a second latching protrusion 56.

An upper coupling protrusion 37 and a lower coupling protrusion 38 are alternately formed on an outer periphery of the button frame 30, in which the coupling protrusion 15 of the container body 10 is fitted between the upper coupling protrusion 37 and the lower coupling protrusion 38, such that the button frame 30 is fixedly coupled to the container body 10.

The support 40 is rotatably hinged to the inside of the container body 10, and the rotation frame 50 is rotatably coupled to the inside of the support 40.

A support grip part 42 is formed on a front surface of the support 40 so that the user can easily grip the support 40.

A support hinge part 48 formed on an opposite side of the support grip part 42 is hinged to the container hinge part 18 together with a lid hinge part 28 by using a hinge pin 17.

A pair of rotation holes 44 are formed on both sides of the support 40.

The rotation frame 50 is rotatably coupled to the inside of the support 40 by a rotation shaft 54.

A pair of protrusions 53 protrude from an outer periphery of the rotation frame 50, and the rotation shafts 54 inserted into the rotation hole 44 of the support 40 are formed at each center of the pair of protrusions 53.

A plurality of second latching protrusions 56 formed on upper and lower portions of the protrusion 53, as shown in FIG. 4, may be formed on both sides of upper portion and both sides of lower portion of the protrusion 53, respectively.

Figure 7:
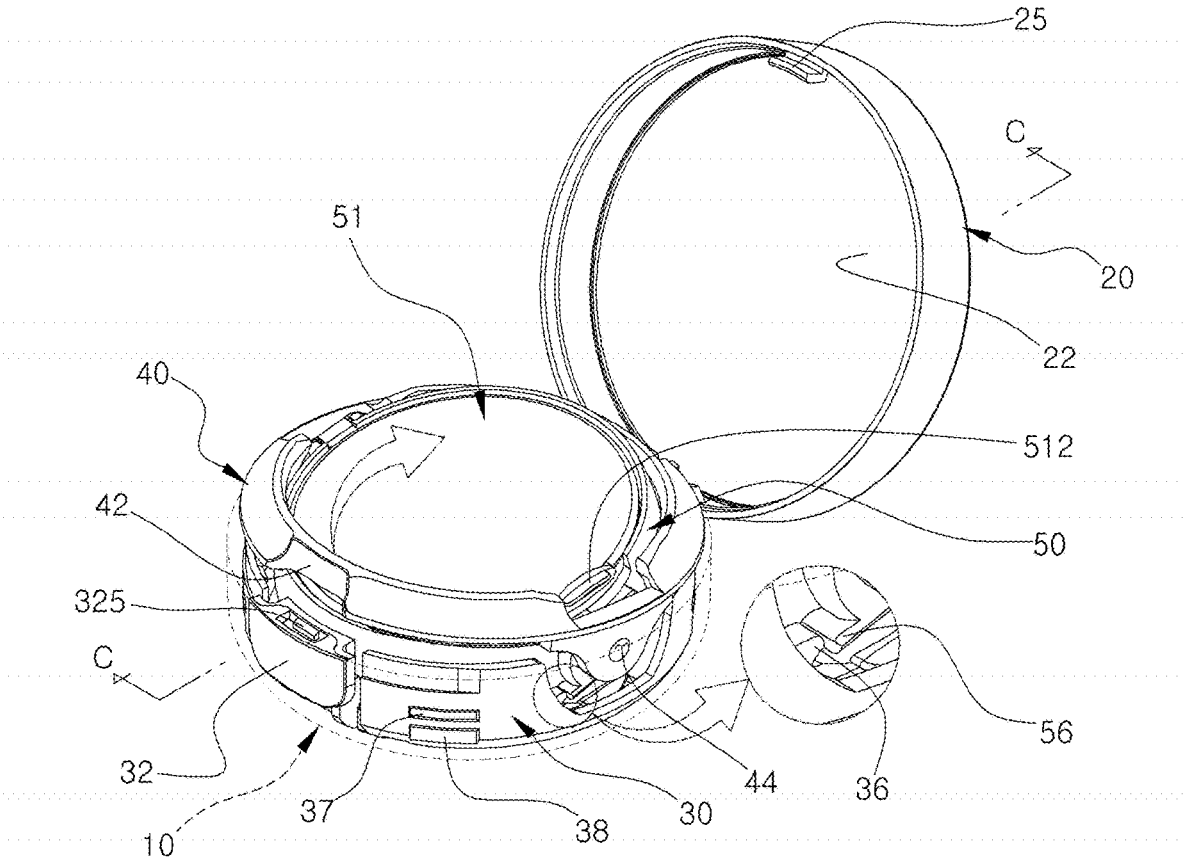
FIG. 7 is a perspective view showing a state of lifting up a support of a compact container having a rotating contents container according to the present invention.
Figure 8:
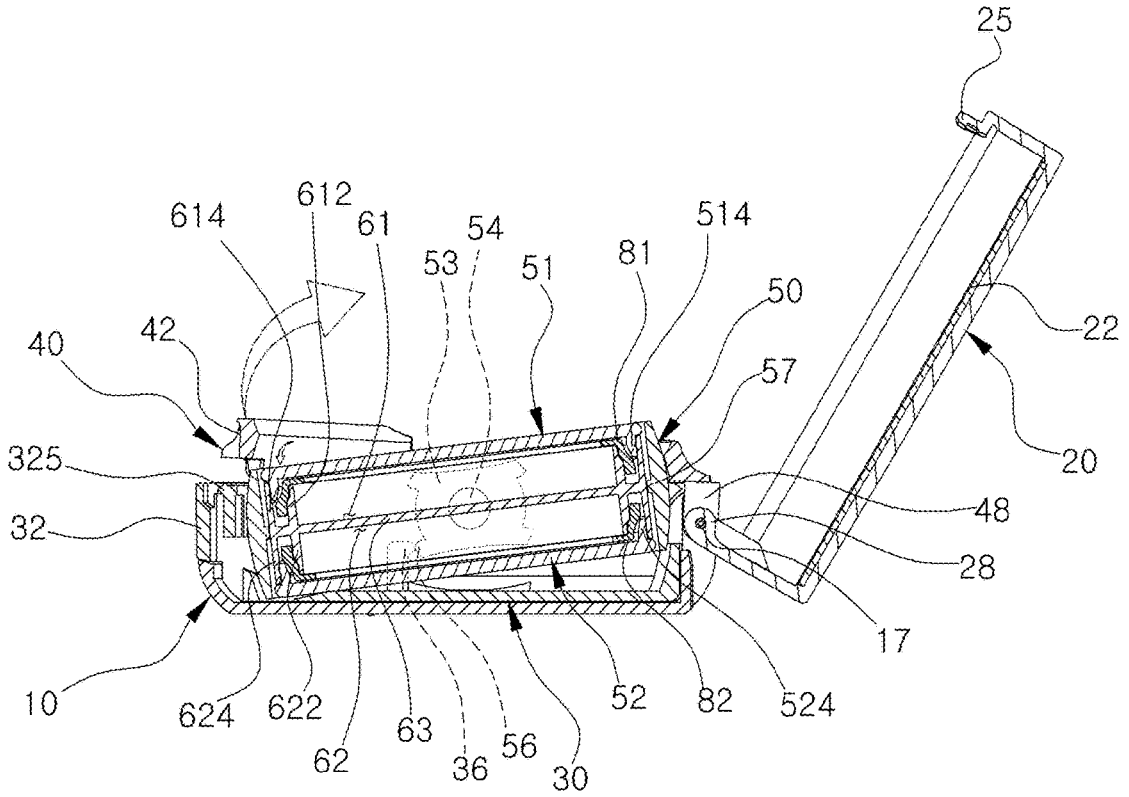
FIG. 8 is a cross sectional view taken along line B-B showing a state of a support of lifting up a compact container having a rotating contents container according to the present invention.

FIG. 7 is a perspective view showing a state of lifting up a support of a compact container having a rotating contents container according to the present invention, and FIG. 8 is a cross sectional view taken along line C-C showing a state of lifting up a support of a compact container having a rotating contents container according to the present invention.

In other words, when the support 40 is lifted from the container body 10 to rotate the contents container 60, the support 40 is rotated upwardly about the hinge pin 18, as an axis, of the container body 10.

At this point, as shown in FIGS. 7 and 8, the second latching protrusion 56 of the rotation frame 50 is latched to the first latching protrusion 36 of the button frame 30, thus the rotation frame 50 is rotated in a direction opposite to the support 40 in a predetermined section, such that the rotation frame 50 and the support 40 are crossed with each other.

Accordingly, the user can rotate the rotation frame at a predetermined angle by simply lifting up the support 40.

In other words, even though the rotation frame 50 is not directly rotated from the support 40 by pushing one side of an upper portion of the rotation frame 50 with a finger in the conventional art, the second latching protrusion 56 of the rotation frame 50 is latched to the first latching protrusion 36 of the button frame 30 just when the support 40 is lifted up, thus the rotation frame 50 is automatically rotated, so that the convenience for use is improved.

A coupling protrusion wheel 57 coupled thereto with the contents container 60 is formed on an inner periphery of the rotation frame 50.

A first contents lid 51 and a second contents lid 52 may be coupled to upper and lower portions of the rotation frame 50, respectively, in which the first contents lid 51 serves to seal a first space 61 of the contents container 60, and the second contents lid 52 serves to seal a second space 62 of the contents container 60.

A first grip 512 and a second grip 522 are formed on each one side of the first and second contents lids 51 and 52, respectively, in which one of the first and second grips 512 and 522, as shown in FIG. 5, is inserted into a grip insertion groove 14 of the container body 10 through the grip insertion hole 34 of the button frame 30.

Accordingly, an empty space is prevented from being formed between a bottom surface of the container body 10 and the first and second contents lids 51 and 52, thus space inside the container body can be efficiently used.

As shown in an enlarged view of FIG. 6, a side surface of the rotation frame 50 is formed in an arc shape such as "(", so that the rotation frame 40 can be easily rotated in the support 30.

The contents container 60 is fixedly coupled to the inside of the rotation frame 50, and accommodated therein with an impregnation member 70 into which a cosmetic material is impregnated.

A partition 63 may be formed in the contents container 60 to divide the inner space of the contents container 60 into a first space 61 and a second space 62, and the first space 61 and the second space 62 may be accommodated therein with the impregnation members 70 into which different kinds of cosmetic materials are impregnated.

The contents container 60 is formed therein with a first inner wall 612 extending upward from the partition 63, and a first outer wall 614 outwardly spaced apart from the first inner wall 612 at a predetermined interval and extending upward, and formed therein with a second inner wall 622 extending downward from the partition 63, and a second outer wall 624 outwardly spaced apart from the second inner wall 622 at a predetermined interval and extending downward.

A first fixture 81 and a second fixture 81 may be coupled to upper sides of the first and second inner walls 612 and 622 of the contents container 60 to prevent the impregnation member 70 accommodated in the contents container 60 from being separated to the outside.

In addition, A first sealing protrusion wheel 514 and a second sealing protrusion wheel 524 are formed under the first and second contents lids 51 and 52, respectively, in which the first sealing protrusion wheel 514 makes close contact with an inner periphery of the first outer wall 614 of the contents container 60, and the second sealing protrusion wheel 524 makes close contact with an inner periphery of the second outer wall 624 of the contents container 60.

An upper fastening protrusion 67 and a lower fastening protrusion 68 are alternately formed on the outer periphery of the contents container 60, in which a fastening protrusion wheel 57 of the rotation frame 50 is fitted between the upper fastening protrusion 67 and the lower fastening protrusion 68, such that the contents container 60 is fixedly coupled to the rotation frame 50.

A method of assembling the compact container having the rotating contents container as configured above will be described as below.

As shown in FIGS. 4 to 6, in order to assemble the compact container having the rotating contents container according to the present invention, firstly, the contents container 60 is coupled to the inside of the rotation frame 50, such that the fastening protrusion wheel 57 of the rotation frame 50 is fitted between the upper fastening protrusion 67 and the lower fastening protrusion 68 of the contents container 60.

Next, the impregnation member 70 impregnated therein with a cosmetic material is inserted into the inside of the first space 61 of the contents container 60, the first fixture 81 is coupled to the first inner wall 612, the contents container 60 is turned upside down, an impregnation member 70 impregnated therein with a different kind of cosmetic material is inserted into the inside of the second space 62, and the second fixture 82 is coupled to the second inner wall 622.

Next, the first contents lid 51 and the second contents lid 52 are hinged to the upper and lower portions of the rotation frame 50, respectively.

Next, the rotation frame 50 is coupled to the inside of the support 40, in which the rotation shaft 54 of the rotation frame 50 is inserted into the rotation groove 44 of the support 40.

Next, the button frame 30 is coupled to the inside of the container body 10, such that the coupling protrusion 15 of the container body 10 is inserted between the upper coupling protrusion 37 and the lower coupling protrusion 38 of the button frame 30.

Next, the lid hinge part 28 of the container lid 20 and the support hinge part 48 of the support 40 are rotatably hinged to the container hinge part 18 of the container body 10 by using the hinge pin 17.

Finally, by pressing the support 40 and the first contents lid 51, the second grip 522 of the second contents lid 52 is inserted into the grip insertion groove 14 of the container body 10 while passing trough the grip insertion hole 34 of the button frame 30, and the second latching protrusion 56 of the rotation frame 50 is latched to the first latching protrusion 36 of the button frame 30, thus the assembly of the compact container having the rotating contents container according to the present invention is completed.

A method of using the compact container having the rotating contents container assembled as above will be described as below.

Figure 9:
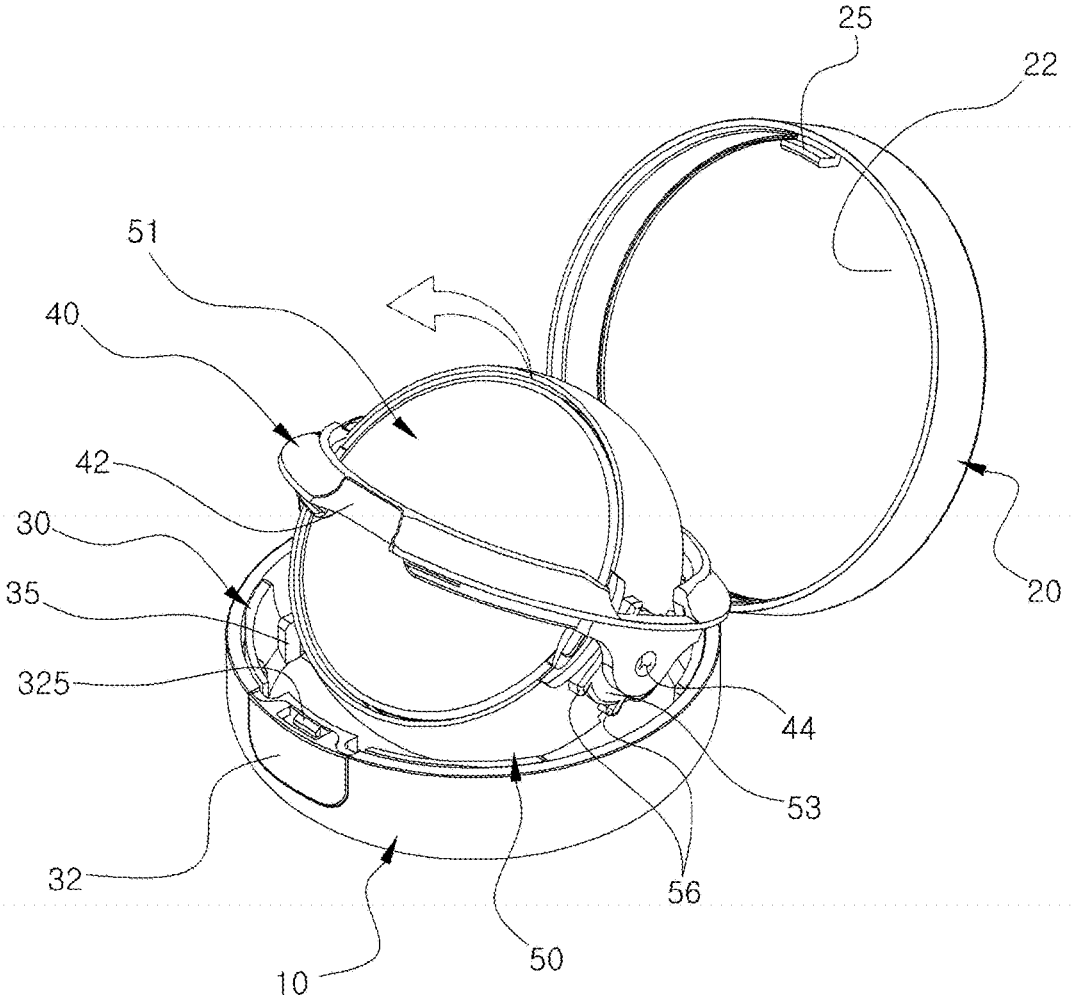
FIG. 9 is a perspective view showing a state of rotating a rotation frame of a compact container having a rotating contents container according to the present invention.

FIG. 9 is a perspective view showing a state of rotating a rotation frame of a compact container having a rotating contents container according to the present invention.

In order to use the compact container having the rotating contents container according to the present invention, firstly, the container lid 20 is opened from the container body 10 by pressing the button 32.

Then, after the first grip 512 of the first contents lid 51 formed over the contents container 60 is gripped and rotated to open the first contents lid 51 from the contents container 60, the impregnated member 70 accommodated in the contents container 60 is drawn with a makeup tool such as a puff and uniformly applied onto a skin.

After the makeup is completed, the first contents lid 51 is rotated to close the contents container 60, and the container lid 20 is rotated to close the container body 10.

When the impregnation member 70 is hardened as being dried after the cosmetic material impregnated into the impregnation member 70 of the compact container having the rotating contents container according to the present invention is completely exhausted, or when the user needs to use the impregnation member 70 impregnated therein with a different kind of cosmetic material, the contents container 60 is required to be turned upside down for use.

First, as shown in FIGS. 7 and 8, the support grip part 42 of the support 40 is griped and the support 40 is lifted to rotate the support 40 upward.

At this point, as shown in the enlarged view of FIG. 7, the second latching protrusion 56 of the rotation frame 50 is latched to the first latching protrusion 36 of the button frame 30, thus the rotation frame 50 is rotated in a direction opposite to the support 40 in a predetermined section, such that the rotation frame 50 and the support 40 are crossed with each other.

Then, the rotation frame 50 is gripped, as shown in FIG. 9, the contents container 60 is turned upside down while the rotation frame 50 is rotated around the rotating groove 44 of the support 40.

Finally, the support 40 and the second contents lid 51 are pressed downwardly, such that the first grip 512 of the first contents lid 51 is inserted into the grip insertion groove 14 of the container body 10 while passing through the grip insertion hole 34 of the button frame 30, and the second latching protrusion 56 of the rotation frame 50 is latched to the first latching protrusion 36 of the button frame 30.

The present invention described in the above is just one embodiment for carrying out the compact container having the rotating contents container, and the present invention is not limited to the embodiments.

Preferable embodiments have been proposed and set forth in the aforementioned description, however the present invention should not be construed as limited thereto, and it will be apparent to those having ordinary skill in the art in that many different substitutions, deformations and modifications are available within the scope without departing from the invention.

What is claimed is:

1. A compact container having a rotating contents container, the compact container comprising:

a container body (10);

a container lid (20) for opening and closing the container body (10);

a button frame (30) coupled to an inside of the container body (10), and formed thereon with a button (32);

a support (40) hinged to the container body (10), and formed therein with a rotation hole (44);

a rotation frame (50) formed thereon with rotation shafts (54) and rotatably coupled to an inside of the support (40);

a contents container (60) fixedly coupled to an inside of the rotation frame (50); and an impregnation member (70) accommodated in the contents container (60), and impregnated therein with a cosmetic material, wherein the button frame (30) is formed thereon with a first latching protrusion (36), and the rotation frame (50) is formed thereon with a second latching protrusion (56) to enable the second latching protrusion (56) to be latched to the first latching protrusion (36) when the support (40) is lifted up, such that the rotation frame (50) is automatically rotated by a predetermined angle, wherein upper and lower portions of the rotation frame (50) are coupled to a first contents lid (51) formed thereon with a first grip (512) and a second contents lid (52) formed thereon with a second grip (522), respectively, and one of the first and second grips (512 and 522) is inserted into a grip insertion groove (14) of the container body (10) while passing through a grip insertion hole (34) of the button frame (30).

2. The compact container of claim 1, wherein the container body (10) is formed on a bottom thereof with the grip insertion groove (14), and the button frame (30) is formed on a bottom thereof with the grip insertion hole (34).

3. The compact container of claim 1, wherein a side surface of the rotation frame (50) is formed in an arc shape, so as to enable the rotation frame (40) to be easily rotated in the support (30).

4. The compact container of claim 1, wherein the contents container (60) is formed therein with a partition (63) to divide an inner space of the contents container (60) into a first space (61) and a second space (62).

* * * * *